US006390340B1

(12) United States Patent
Lynch, Sr.

(10) Patent No.: US 6,390,340 B1
(45) Date of Patent: May 21, 2002

(54) LIQUID SOAP DISPENSER

(76) Inventor: Daniel Lynch, Sr., P.O. Box 8176, Waukegan, IL (US) 60079

( * ) Notice: Subject to any disclaimer, the term of this patent is extended or adjusted under 35 U.S.C. 154(b) by 0 days.

(21) Appl. No.: 09/607,351

(22) Filed: Jun. 30, 2000

(51) Int. Cl.[7] ..... B65D 83/00

(52) U.S. Cl. ..... 222/399; 222/394; 222/78; 137/206; 137/209

(58) Field of Search ..... 222/394, 399, 222/78, 401, 401.7, 40.8; 4/628; 137/209, 206

(56) References Cited

U.S. PATENT DOCUMENTS 466,336 A * 1/1892 Franklin ..... 222/204
467,353 A * 1/1892 Hullhorst ..... 4/625
923,447 A * 6/1909 Schmidt ..... 222/180
1,327,162 A 1/1920 Knight
3,219,237 A * 11/1965 Jackson ..... 222/78
3,388,835 A * 6/1968 Naughten ..... 222/78
3,917,172 A 11/1975 O'hare
4,341,078 A * 7/1982 Weitzen ..... 62/48
4,625,896 A 12/1986 Rocchelli
4,630,756 A * 12/1986 Amici et al. ..... 222/78
4,887,651 A * 12/1989 Santiago ..... 141/1
5,071,387 A * 12/1991 Pottick ..... 446/475
5,114,048 A 5/1992 Minke
D341,875 S 11/1993 Allen et al.
5,301,836 A * 4/1994 Luu ..... 222/78
5,318,202 A * 6/1994 D'Andrade ..... 222/78
5,456,626 A * 10/1995 Ming-Kang ..... 446/397
5,564,602 A * 10/1996 Cleland et al. ..... 222/146.6
5,570,813 A * 11/1996 Clark, II ..... 222/1
5,593,641 A * 1/1997 Hornberger, Sr. ..... 422/123
5,605,485 A * 2/1997 Spector ..... 446/72
5,730,323 A * 3/1998 Osborne ..... 222/55
5,881,915 A * 3/1999 Smrz ..... 222/78
6,059,145 A * 5/2000 Stratton et al. ..... 222/78
6,195,910 B1 * 3/2001 Robineau ..... 34/417

* cited by examiner

*Primary Examiner*—Henry C. Yuen
*Assistant Examiner*—Frederick C Nicolas

(57) ABSTRACT

A liquid soap dispenser for dispensing liquid soap. The liquid soap dispenser includes a housing with a soap reservoir and a pressurized gas reservoir disposed in the housing. The pressurized gas reservoir is in fluid communication with the soap reservoir. A dispensing valve is provided between the pressurized gas reservoir and the soap reservoir for selectively opening and closing passage of gas from the pressurized gas reservoir to the soap reservoir. The dispensing valve has an actuator extending from the housing. An elongate flexible dispensing tube in fluid communication with the soap reservoir outwardly extends from the housing.

1 Claim, 2 Drawing Sheets

LIQUID SOAP DISPENSER

BACKGROUND OF THE INVENTION

1. Field of the Invention

The present invention relates to liquid soap dispensers and more particularly pertains to a new liquid soap dispenser for dispensing liquid soap.

2. Description of the Prior Art

The use of liquid soap dispensers is known in the prior art. More specifically, liquid soap dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,625,896; U.S. Pat. No. 3,917,172; U.S. Pat. No. 5,114,048; U.S. Pat. No. 4,218,013; U.S. Pat. No. 1,327,162; and U.S. Pat. No. Des. 341,875.

While these devices fulfill their respective, particular objectives and requirements, the aforementioned patents do not disclose a new liquid soap dispenser. The inventive device includes a housing with a soap reservoir and a pressurized gas reservoir disposed in the housing. The pressurized gas reservoir is in fluid communication with the soap reservoir. A dispensing valve is provided between the pressurized gas reservoir and the soap reservoir for selectively opening and closing passage of gas from the pressurized gas reservoir to the soap reservoir. The dispensing valve has an actuator extending from the housing. An elongate flexible dispensing tube in fluid communication with the soap reservoir outwardly extends from the housing.

In these respects, the liquid soap dispenser according to the present invention substantially departs from the conventional concepts and designs of the prior art, and in so doing provides an apparatus primarily developed for the purpose of dispensing liquid soap.

SUMMARY OF THE INVENTION

In view of the foregoing disadvantages inherent in the known types of liquid soap dispensers now present in the prior art, the present invention provides a new liquid soap dispenser construction wherein the same can be utilized for dispensing liquid soap.

The general purpose of the present invention, which will be described subsequently in greater detail, is to provide a new liquid soap dispenser apparatus and method which has many of the advantages of the liquid soap dispensers mentioned heretofore and many novel features that result in a new liquid soap dispenser which is not anticipated, rendered obvious, suggested, or even implied by any of the prior art liquid soap dispensers, either alone or in any combination thereof.

To attain this, the present invention generally comprises a housing with a soap reservoir and a pressurized gas reservoir disposed in the housing. The pressurized gas reservoir is in fluid communication with the soap reservoir. A dispensing valve is provided between the pressurized gas reservoir and the soap reservoir for selectively opening and closing passage of gas from the pressurized gas reservoir to the soap reservoir. The dispensing valve has an actuator extending from the housing. An elongate flexible dispensing tube in fluid communication with the soap reservoir outwardly extends from the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new liquid soap dispenser apparatus and method which has many of the advantages of the liquid soap dispensers mentioned heretofore and many novel features that result in a new liquid soap dispenser which is not anticipated, rendered obvious, suggested, or even implied by any of the prior art liquid soap dispensers, either alone or in any combination thereof.

It is another object of the present invention to provide a new liquid soap dispenser which may be easily and efficiently manufactured and marketed.

It is a further object of the present invention to provide a new liquid soap dispenser which is of a durable and reliable construction.

An even further object of the present invention is to provide a new liquid soap dispenser which is susceptible of a low cost of manufacture with regard to both materials and labor, and which accordingly is then susceptible of low prices of sale to the consuming public, thereby making such liquid soap dispenser economically available to the buying public.

Still yet another object of the present invention is to provide a new liquid soap dispenser which provides in the apparatuses and methods of the prior art some of the advantages thereof, while simultaneously overcoming some of the disadvantages normally associated therewith.

Still another object of the present invention is to provide a new liquid soap dispenser for dispensing liquid soap.

Yet another object of the present invention is to provide a new liquid soap dispenser which includes a housing with a soap reservoir and a pressurized gas reservoir disposed in the housing. The pressurized gas reservoir is in fluid communication with the soap reservoir. A dispensing valve is provided between the pressurized gas reservoir and the soap reservoir for selectively opening and closing passage of gas from the pressurized gas reservoir to the soap reservoir. The dispensing valve has an actuator extending from the housing. An elongate flexible dispensing tube in fluid communication with the soap reservoir outwardly extends from the housing.

Still yet another object of the present invention is to provide a new liquid soap dispenser that dispense liquid soap, preferably liquid dishwashing soap at the mouth of faucet spout so that the liquid soap is mixed with water flowing out of the mouth of the faucet spout into a sink therebelow.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
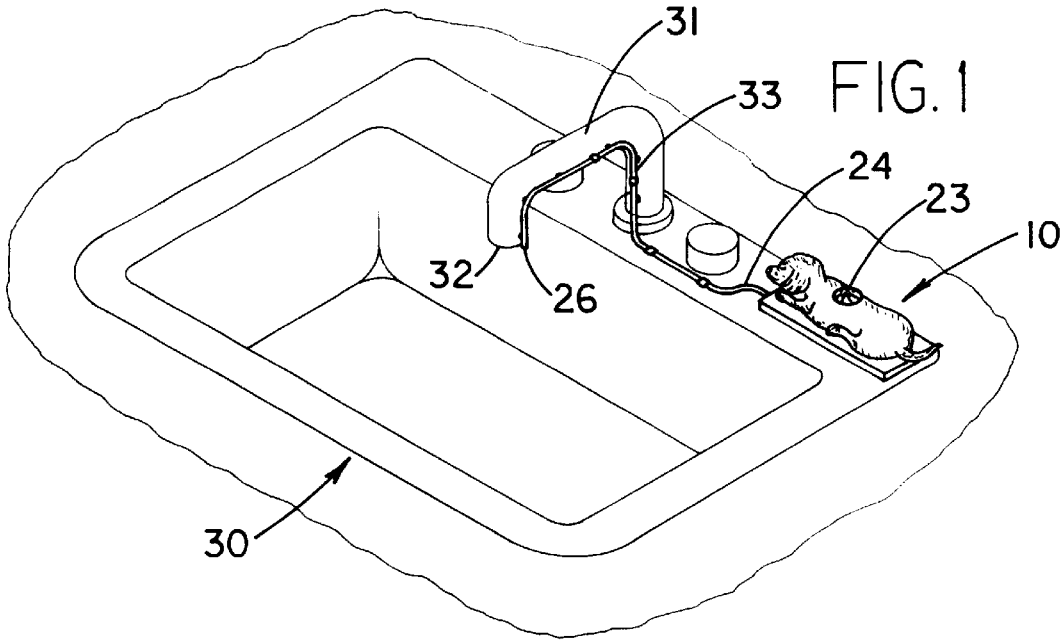
FIG. 1 is a schematic perspective view of a new liquid soap dispenser in use adjacent a sink according to the present invention.
Figure 2:
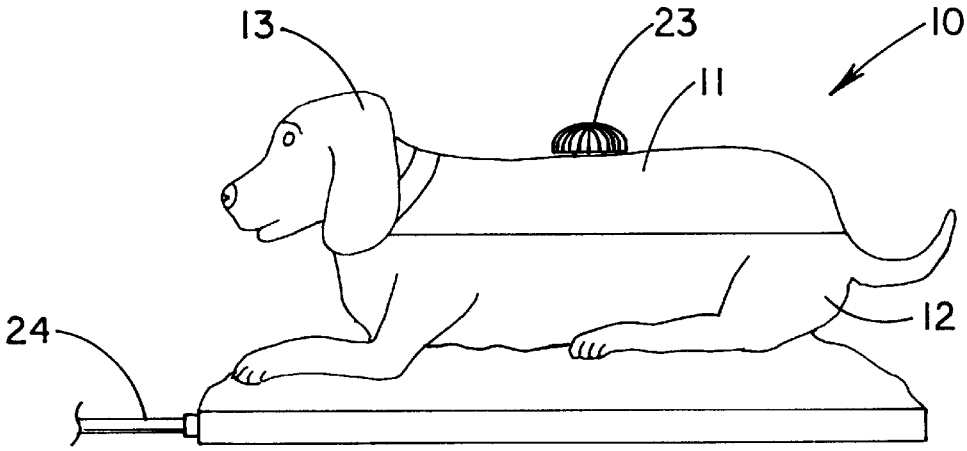
FIG. 2 is a schematic side view of the housing of the present invention.
Figure 3:
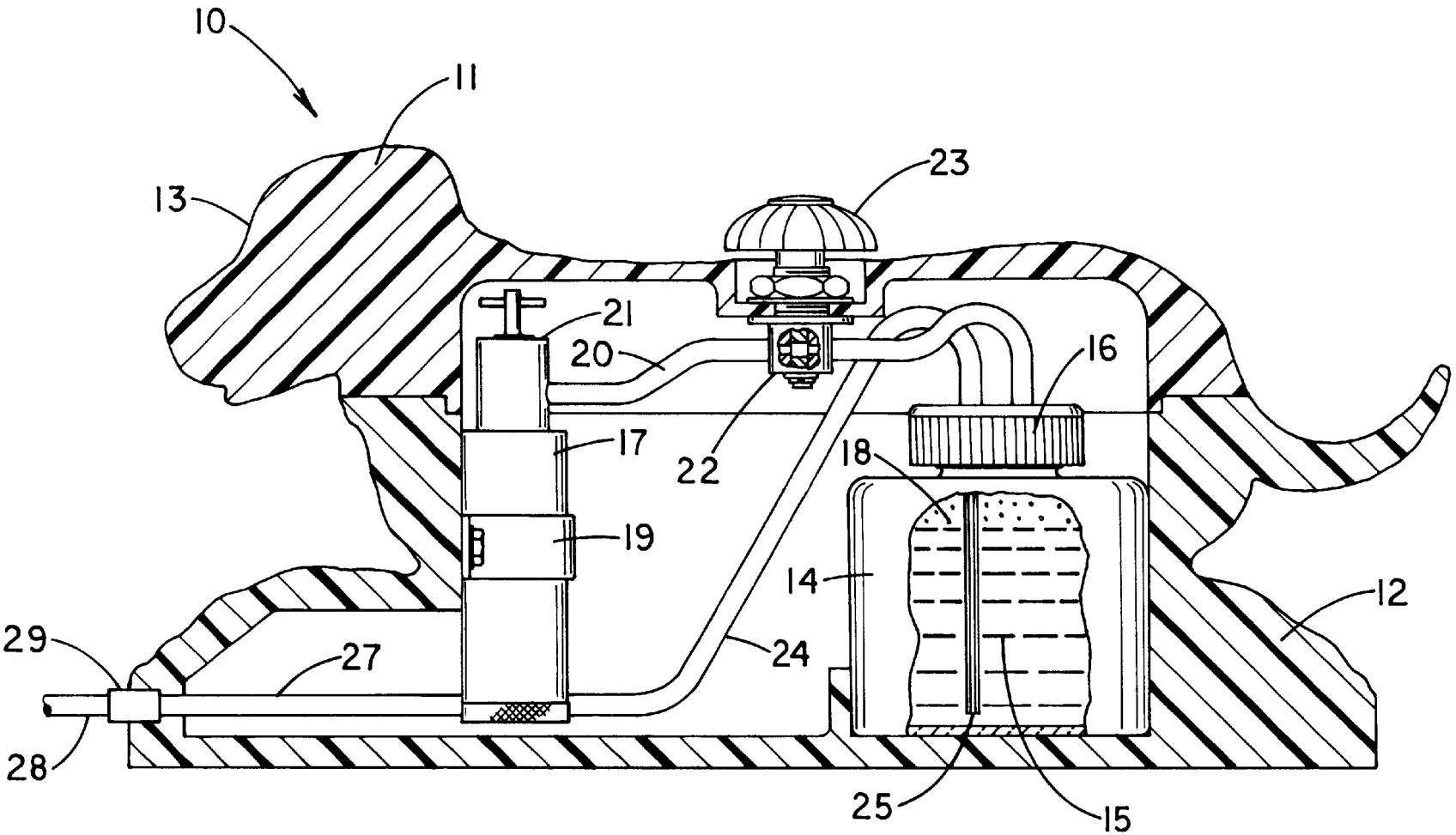
FIG. 3 is a schematic cross sectional view of the housing of the present invention to reveal the soap reservoir and the pressurized gas reservoir.

With reference now to the drawings, and in particular to FIGS. 1 through 3 thereof, a new liquid soap dispenser embodying the principles and concepts of the present invention will be described.

As best illustrated in FIGS. 1 through 3, the liquid soap dispenser generally comprises a housing with a soap reservoir and a pressurized gas reservoir disposed in the housing. The pressurized gas reservoir is in fluid communication with the soap reservoir. A dispensing valve is provided between the pressurized gas reservoir and the soap reservoir for selectively opening and closing passage of gas from the pressurized gas reservoir to the soap reservoir. The dispensing valve has an actuator extending from the housing. An elongate flexible dispensing tube in fluid communication with the soap reservoir outwardly extends from the housing.

In closer detail, the liquid soap dispenser comprises a housing 10 preferably having separable upper and lower portions 11,12 with the upper portion of the housing resting on the lower portion of the housing. Ideally, as illustrated in FIG. 2, the housing has an outer surface 13 shaped and configured to resemble an animal or person.

A soap reservoir 14 for holding liquid soap 15 therein is disposed in the housing. Preferably, the soap reservoir has a removable top cap 16 to permit access into the soap reservoir for refilling of liquid soap therein.

A pressurized gas reservoir 17 for holding pressurized gas 18 therein (such as a pressurized $CO_2$ cartridge) is also disposed in the housing. Preferably, a bracket 19 mounts the pressurized gas reservoir to the lower portion of the housing. The pressurized gas reservoir is in fluid communication with the soap reservoir by a flexible connecting tube 20 to permit passage of gas from the pressurized gas reservoir to the soap reservoir. As best illustrated in FIG. 3, the connecting tube has an opening into the soap dispenser at the top cap of the soap reservoir such that the opening of the connecting tube is above the surface level of the liquid soap in the soap reservoir. Preferably, the pressurized gas reservoir has a master valve 21 for selectively opening and closing passage of gas from the pressurized gas reservoir to the soap reservoir.

A dispensing valve 22 is provided in the connecting tube between the pressurized gas reservoir and the soap reservoir for selectively opening and closing passage of gas from the pressurized gas reservoir to the soap reservoir. The dispensing valve has an actuator—preferably a knob 23—rotatably mounted to the upper portion of the housing. The knob is rotatable between open and closed positions. In use, the dispensing valve is open to permit passage of gas from the pressurized gas reservoir to the soap reservoir when the knob is rotated to the open position. Conversely, the dispensing valve is closed to block passage of gas from the pressurized gas reservoir to the soap reservoir when the knob is rotated to the closed position.

An elongate flexible dispensing tube 24 outwardly extends from the lower portion of the housing. The dispensing tube has opposite open proximal and distal ends 25,26. With reference to FIG. 3, the proximal end of the dispensing tube is inserted into the soap reservoir through the top cap of the soap reservoir to fluidly connect the dispensing tube to the soap reservoir. The proximal end of the dispensing tube is extended towards a bottom region of the soap reservoir such that the proximal end of the dispensing tube is below the surface level of the liquid soap in the dispenser and below the opening of the connecting tube in the soap dispenser.

In a preferred embodiment, the dispensing tube comprises a plurality of interconnected separable tubular segments arranged in series between the ends of the dispensing tube with each segment detachably attached to the adjacent two segments by detachably couplings so that addition segments may be attached to lengthen the dispensing tube and segments may be detached to shorten the dispensing tube and to permit replacement of damaged segments.

As best illustrated in FIG. 3, a first of the segments 27 is located in the housing and an adjacent second of the segments 28 of the dispensing tube is located adjacent the housing. The first and second segments of the dispensing tube is detachably attached together at a coupling 29 located at the outer surface of the housing. This allows replacement of the second segment which is at a weak point due to possible excessive bending of the dispensing tube at the outer surface of the housing.

The liquid soap dispenser is preferably designed for use with a sink 30 having a faucet spout 31 has an open mouth 32. The housing is rested on a counter surface adjacent the sink. The dispensing tube is extended along the faucet spout such that distal end of the dispensing tube is positioned adjacent the mouth of the faucet spout. The dispensing tube is coupled to the faucet spout preferably by an adhesive 33 or fastening bands wrapped around the faucet spout and the dispensing tube.

In use, the master valve is left in an open position to permit passage of gas out of the pressurized gas reservoir. The knob of the dispensing valve is rotated from the closed position to the open position to permit passage of pressurized gas into the soap reservoir. When sufficient pressure is built up in the soap reservoir by the gas, the liquid soap in the soap reservoir is forced out of the soap reservoir into the dispensing tube and in turn out of the distal end of the dispensing tube to fall into the sink. If water is flowing out of the faucet spout at the same time, the water and the liquid soap coming out of the distal end of the dispensing tube are mixed together as they fall into the sink.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liquid soap dispensing system, comprising:

a housing having separable upper and lower portions, said upper portion of said housing resting on said lower portion of said housing, said housing having an outer surface shaped and configured to resemble an animal;

a soap reservoir for holding liquid soap therein being disposed in said housing, said soap reservoir having a removable top cap;

a pressurized gas reservoir for holding pressurized gas therein being disposed in said housing and being in fluid communication with said soap reservoir by a flexible connecting tube to permit passage of gas from said pressurized gas reservoir to said soap reservoir, said connecting tube having an opening into said soap dispenser at said top cap of said soap reservoir such that the opening of the connecting tube is above the surface level of the liquid soap in the soap reservoir;

a bracket mounting said pressurized gas reservoir to said lower portion of said housing;

said pressurized gas reservoir having a master valve for selectively opening and closing passage of gas from said pressurized gas reservoir to said soap reservoir;

a dispensing valve in said connecting tube between said pressurized gas reservoir and said soap reservoir for selectively opening and closing passage of gas from said pressurized gas reservoir to said soap reservoir;

said dispensing valve having a knob rotatably mounted to said upper portion of said housing;

said knob being rotatable between open and closed positions;

wherein said dispensing valve is open to permit passage of gas from said pressurized gas reservoir to said soap reservoir when said knob is rotated to said open position, wherein said dispensing valve is closed to block passage of gas from said pressurized gas reservoir to said soap reservoir when said knob is rotated to said closed position;

an elongate flexible dispensing tube having opposite open proximal and distal ends, said proximal end of said dispensing tube being inserted into said soap reservoir through said top cap of said soap reservoir to fluidly connect said dispensing tube to said soap reservoir;

said dispensing tube being outwardly extended from said lower portion of said housing;

said dispensing tube comprising a plurality of interconnected separable tubular segments arranged in series between said ends of said dispensing tube with each segment detachably attached to the adjacent two segments by detachably couplings so that addition segments may be attached to lengthen the dispensing tube and segments may be detached to shorten the dispensing tube and to permit replacement of damaged segments;

a first of said segments being located in said housing, a second of said segments of said dispensing tube being located adjacent said housing, said first and second segments of said dispensing tube being detachably attached together at a coupling located at said outer surface of said housing;

a sink having a faucet spout having an open mouth; and said housing being rested on a surface adjacent said sink, said dispensing tube being extended along said faucet spout such that distal end of said dispensing tube is positioned adjacent said mouth of said faucet spout, said dispensing tube being coupled to said faucet spout.

* * * * *